US010603246B2

(12) United States Patent
Ho

(10) Patent No.: US 10,603,246 B2
(45) Date of Patent: Mar. 31, 2020

(54) MAGNETIC COUPLE JET FOR HYDROTHERAPY SPA EQUIPMENT

(71) Applicant: KSI Global LLC., Tainan (TW)

(72) Inventor: Kuo-Hsiang Ho, Tainan (TW)

(73) Assignee: KSI Global LLC, Tainan (TW)

( * ) Notice: Subject to any disclaimer, the term of this patent is extended or adjusted under 35 U.S.C. 154(b) by 0 days.

(21) Appl. No.: 16/104,275

(22) Filed: Aug. 17, 2018

(65) Prior Publication Data

US 2020/0054521 A1 Feb. 20, 2020

(51) Int. Cl.
*A61H 33/00* (2006.01)

(52) U.S. Cl.
CPC . *A61H 33/6057* (2013.01); *A61H 2201/1215* (2013.01)

(58) Field of Classification Search
CPC ..... A61H 33/6057
USPC ..... 4/541.6, 622
See application file for complete search history.

(56) References Cited

U.S. PATENT DOCUMENTS 10,278,894 B1 * 5/2019 Le ..... A61H 33/6047
2010/0239435 A1 * 9/2010 Le ..... F04F 5/10 417/54

* cited by examiner

*Primary Examiner* — Christine J Skubinna
(74) *Attorney, Agent, or Firm* — Alan D. Kamrath; Karin L. Williams; Mayer & Williams PC

(57) ABSTRACT

A magnetic couple jet for hydrotherapy spa equipment contains: a motor, a fixer, and a water jet assembly. The motor includes a rotary shaft and a magnet disc set. The fixer includes a first positioning holder and a second positioning holder, wherein the second positioning holder includes a coupling face and at least one first affix portion. An accommodation chamber is defined between the second positioning holder and the first positioning holder so as to accommodate the rotary shaft and the magnet disc set of the motor. The water jet assembly includes a covering member, an impeller, and a magnet, wherein the covering member has a holding seat, a cap, and a receiving room. The holding seat has an orifice, at least one second affix portion, at least one inlet, and at least one outlet. The impeller has multiple fans, a column, and a housing groove formed.

6 Claims, 8 Drawing Sheets

MAGNETIC COUPLE JET FOR HYDROTHERAPY SPA EQUIPMENT

BACKGROUND OF THE INVENTION

Field of the Invention

The present invention relates to a couple jet, and more particularly to a magnetic couple jet for hydrotherapy spa equipment.

Description of the Prior Art

Hydrotherapy spa is one of physiotherapies and is applied to treat the human body by ways of physical properties of water. Hydrotherapy spa equipment contains a spray head configured to jet pressured water to the human body after water is drawn and pressurized, thus obtaining a massaging effect. The spray head contains a motor including a rotary shaft on which an impeller is fixed and is configured to recycle water in the spray head. A seal element is configured to avoid the water contacting the motor, but it is easily broken after a period of using time, and hence the water flows into and damages the motor.

To overcome above-mentioned problem, a water jet assembly has been developed and includes a bearing member and a connection member. The bearing member contains an external part and an internal part, and the external part includes a first cylindrical portion which has a first segment, a second segment, and an accommodation orifice extending from the first segment to the second segment and configured to accommodate the internal part. The external part is secured in a receiving hole of a magnetic impeller of the water jet assembly, and the external part is made of plastic material or engineering plastic. The internal part includes a second cylindrical portion which has a third segment, a fourth segment, a through orifice extending from the third segment to the fourth segment, and the internal part is made of rubber or rubber-shaped material. The connection member includes a fixing element, a protective element, and a locking mechanism. The connection member is mounted in a case of the water jet assembly, and the fixing element includes a third cylindrical portion which has a fifth segment and a sixth segment, with the fixing element made of steel or metal material, and the protective element includes a fourth cylindrical portion which has a seventh segment, an eighth segment, and a fitting orifice extending from the seventh segment and the eighth segment, with the fitting orifice configured to receive the fixing element, and the protective element is accommodated in the through orifice of the internal part. The protective element is made of hard material, and the locking mechanism fixes the magnetic impeller in the case of the water jet assembly so that the magnetic impeller rotates in the case to guide fluid.

However, the water jet assembly contains the bearing member and the connection member, the bearing member contains the external part and the internal part, and the connection member includes the fixing element, the protective element, and the locking mechanism, thus having a complicated structure, being troublesome to manufacture, having a high fabrication cost, and a high failure rate.

The present invention has arisen to mitigate and/or obviate the afore-described disadvantages.

SUMMARY OF THE INVENTION

The primary objective of the present invention is to provide a magnetic couple jet for hydrotherapy spa equipment which contains a water jet assembly that is simplified and machined easily, and tile fabrication cost and failure rate of the water jet assembly are reduced, thus enhancing market competitiveness.

To obtain above-mentioned object, a magnetic couple jet for hydrotherapy spa equipment provided by the present invention contains a motor, a fixer, and a water jet assembly.

The motor includes a rotary shaft and a magnet disc set connected on the rotary shaft.

The fixer includes a first positioning holder and a second positioning holder, the first positioning holder locked on the motor, and the second positioning holder connected with the first positioning holder. The second positioning holder has a coupling face formed on an end of the second positioning holder away from the first positioning holder, and at least one first affix portion is arranged on the coupling face, with an accommodation chamber defined between the second positioning holder and the first positioning holder so as to accommodate the rotary shaft and the magnet disc set of the motor.

The water jet assembly includes a covering member, an impeller, and a magnet. The covering member has a holding seat, a cap connected with the holding seat, and a receiving room formed in the holding seat and the cap. The holding seat has an orifice formed on one surface thereof facing the cap, at least one second affix portion being back to the holding seat corresponding to the at least one first affix portion of the fixer, at least one inlet, and at least one outlet communicating with the receiving room, the holding seat has at least one inlet and at least one outlet communicating with the receiving room.

The impeller is housed in the receiving room, and the impeller has multiple fans radially arranged on one surface thereof facing the cap, a column formed on a center of the other surface of the impeller and rotatably connected in the orifice of the cap so that the impeller is driven by an external force to rotate, and a housing groove formed on the other surface thereof opposite to the cap and accommodating the magnet.

When the magnet magnetically attracts with the magnet disc set of the motor to produce magnetic field and the at least one second affix portion of the cap connects with the at least one first affix portion of the fixer, the water jet assembly magnetically attracts with the coupling face of the fixer, the magnet disc set of the rotary shaft of the motor actuates the magnet and the impeller to revolve via the magnetic field.

DETAILED DESCRIPTION OF THE PREFERRED EMBODIMENTS

Figure 1:
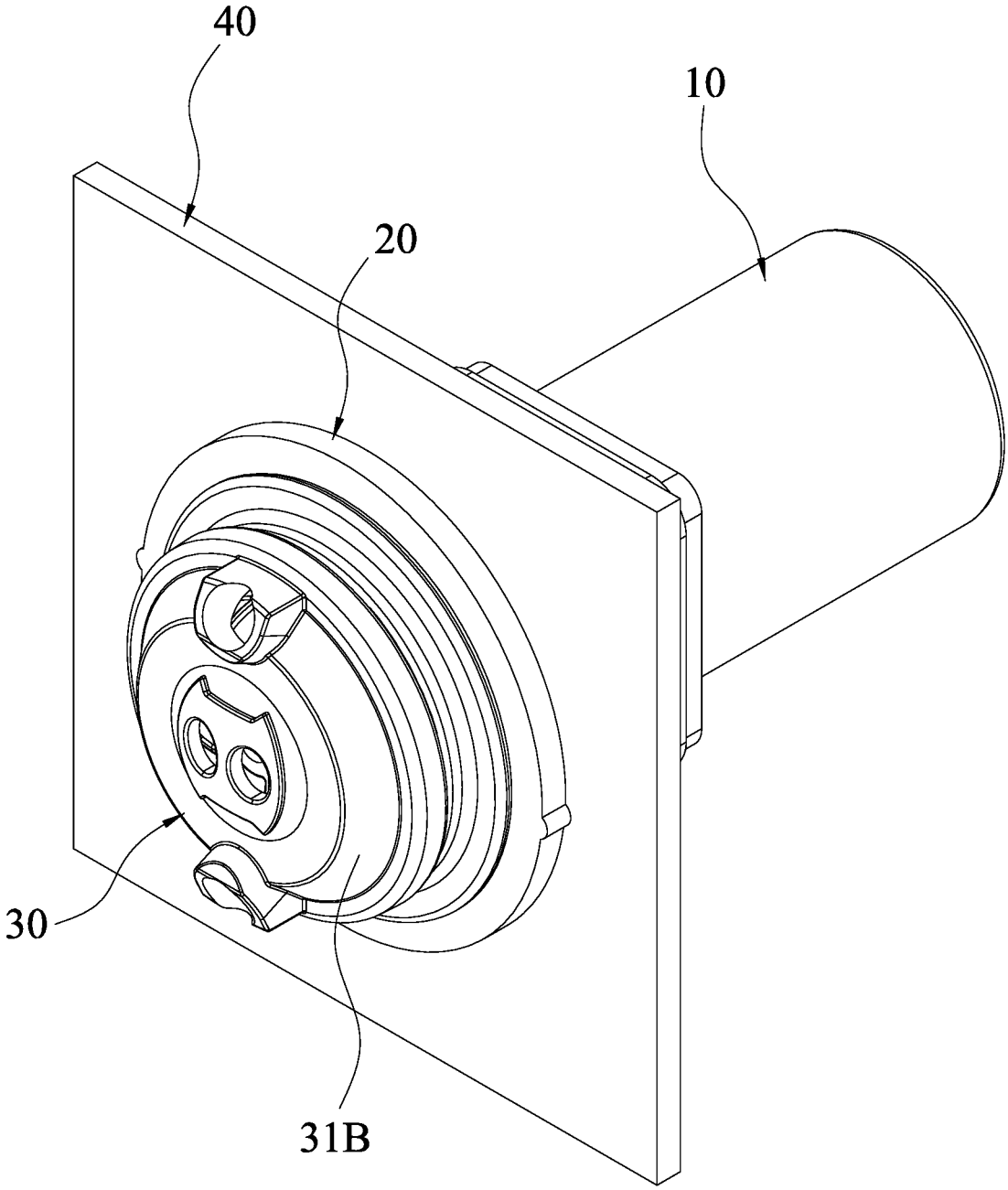
FIG. 1 is a perspective view showing the assembly of a magnetic couple jet for hydrotherapy spa equipment according to a first embodiment of the present invention.
Figure 2:
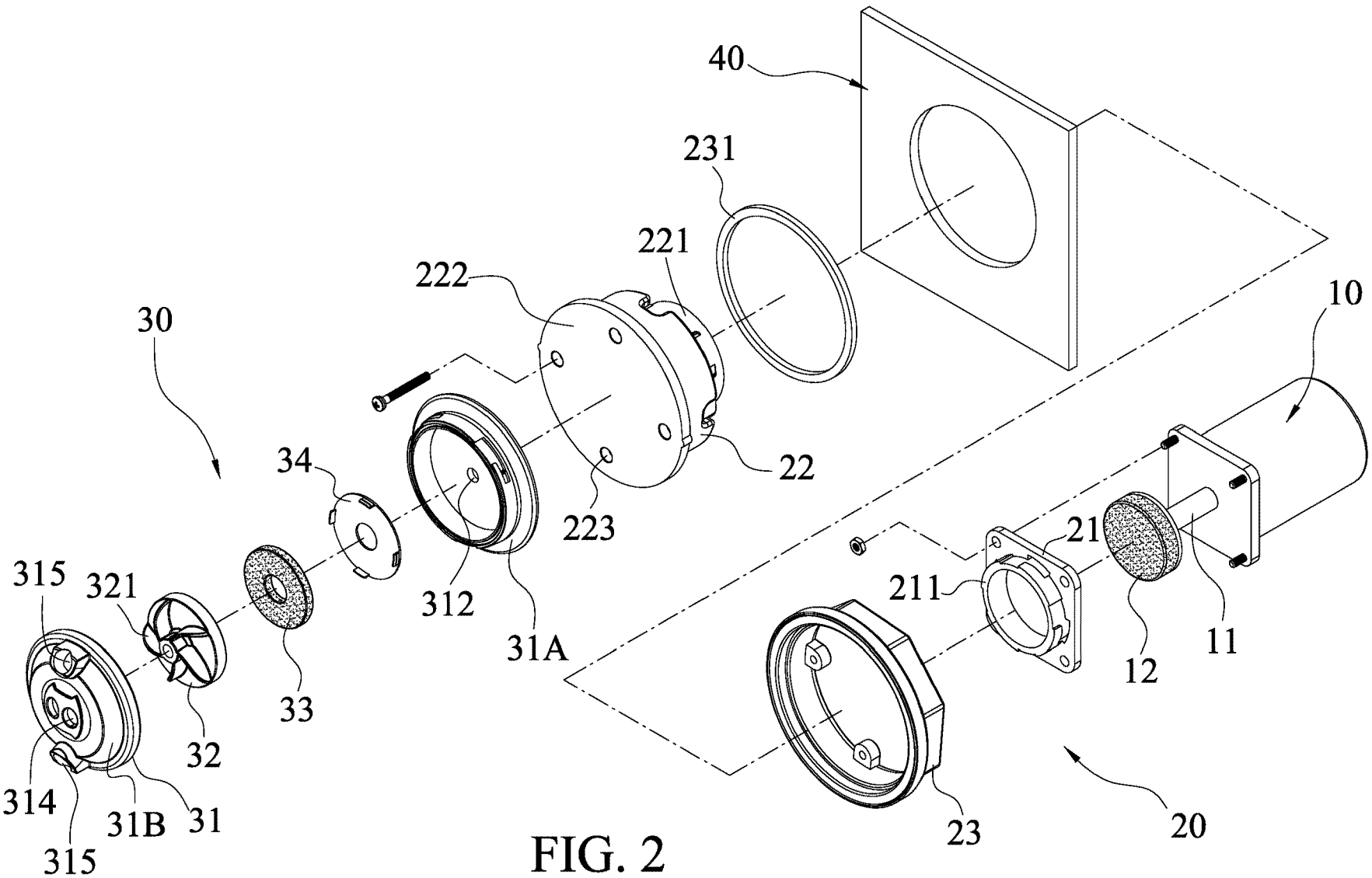
FIG. 2 is a perspective view showing the exploded components of the magnetic couple jet according to the first embodiment of the present invention.
Figure 3:
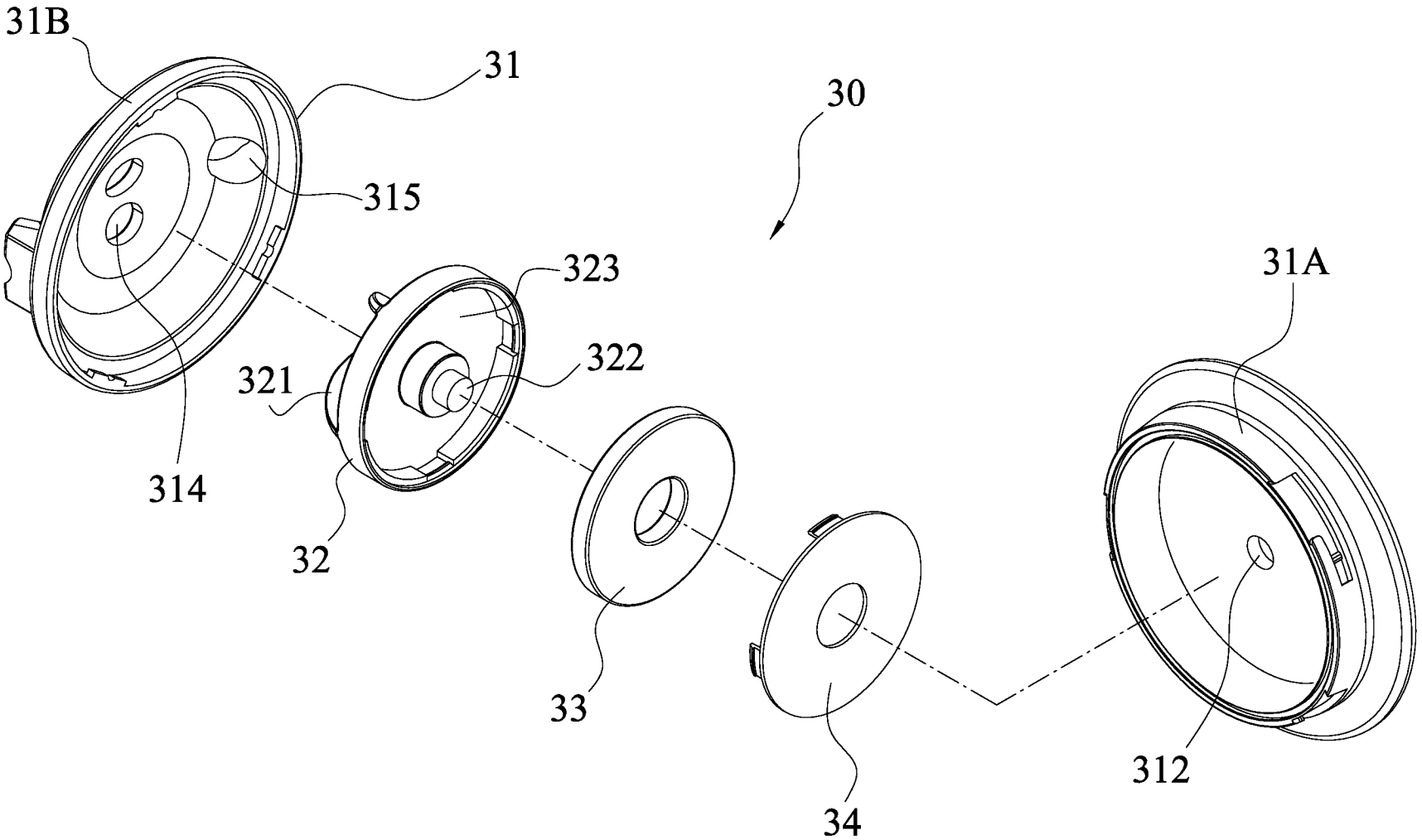
FIG. 3 is a perspective view showing the exploded components of a part of the magnetic couple jet according to the first embodiment of the present invention.
Figure 4:
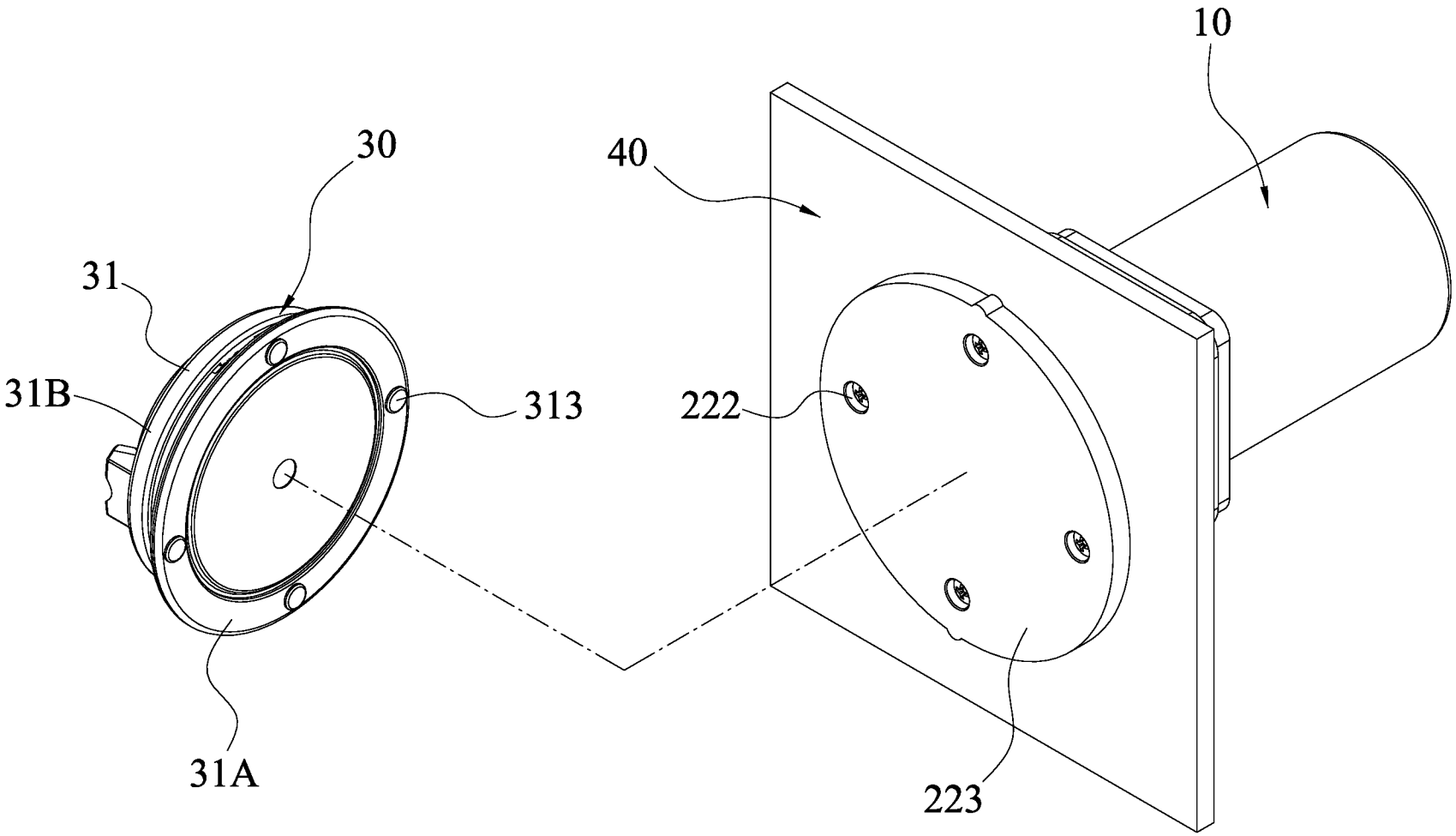
FIG. 4 is another perspective view showing the exploded components of a part of the magnetic couple jet according to the first embodiment of the present invention.
Figure 5:
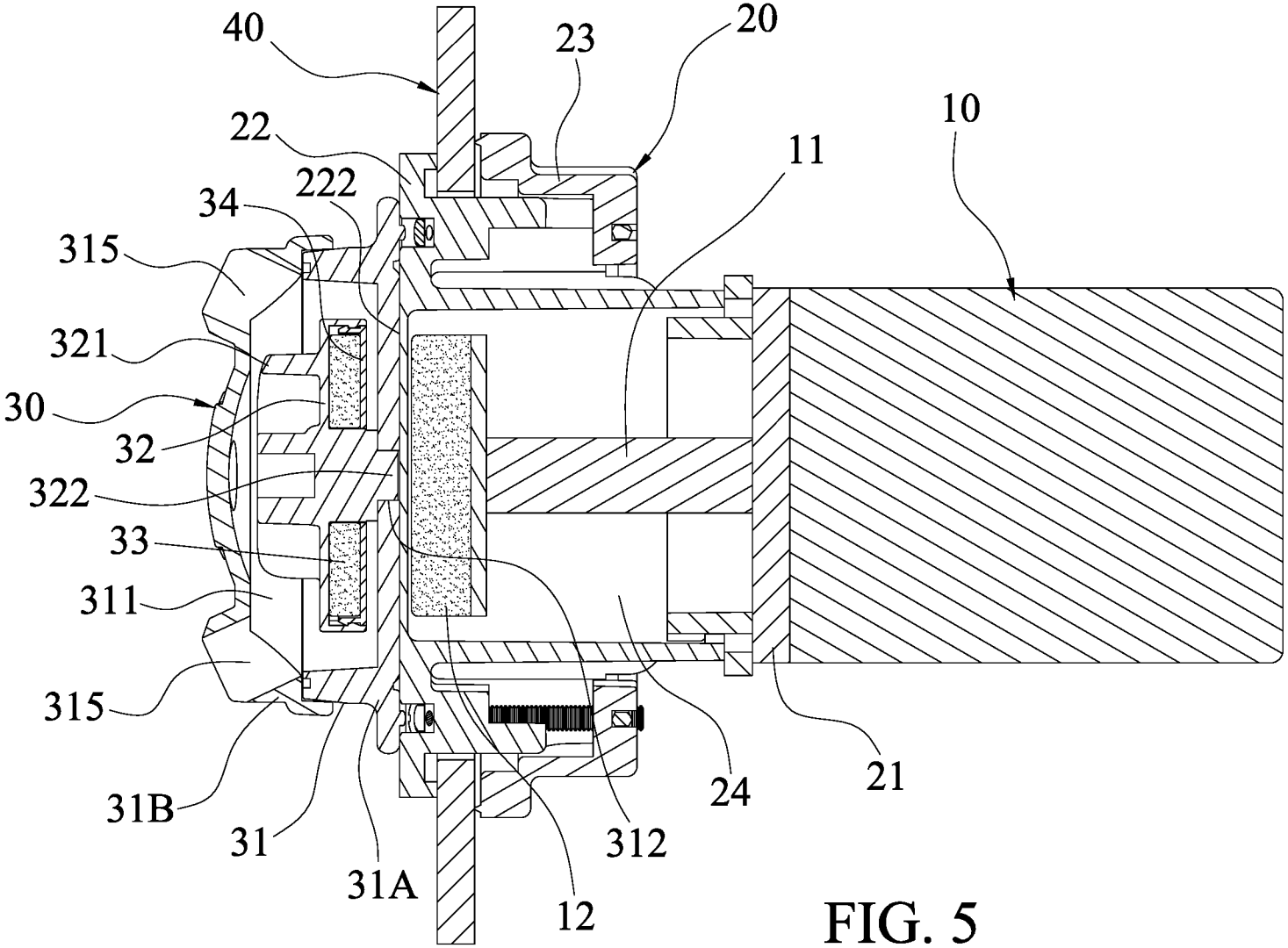
FIG. 5 is a cross sectional view showing the assembly of the magnetic couple jet according to the first embodiment of the present invention.
Figure 6:
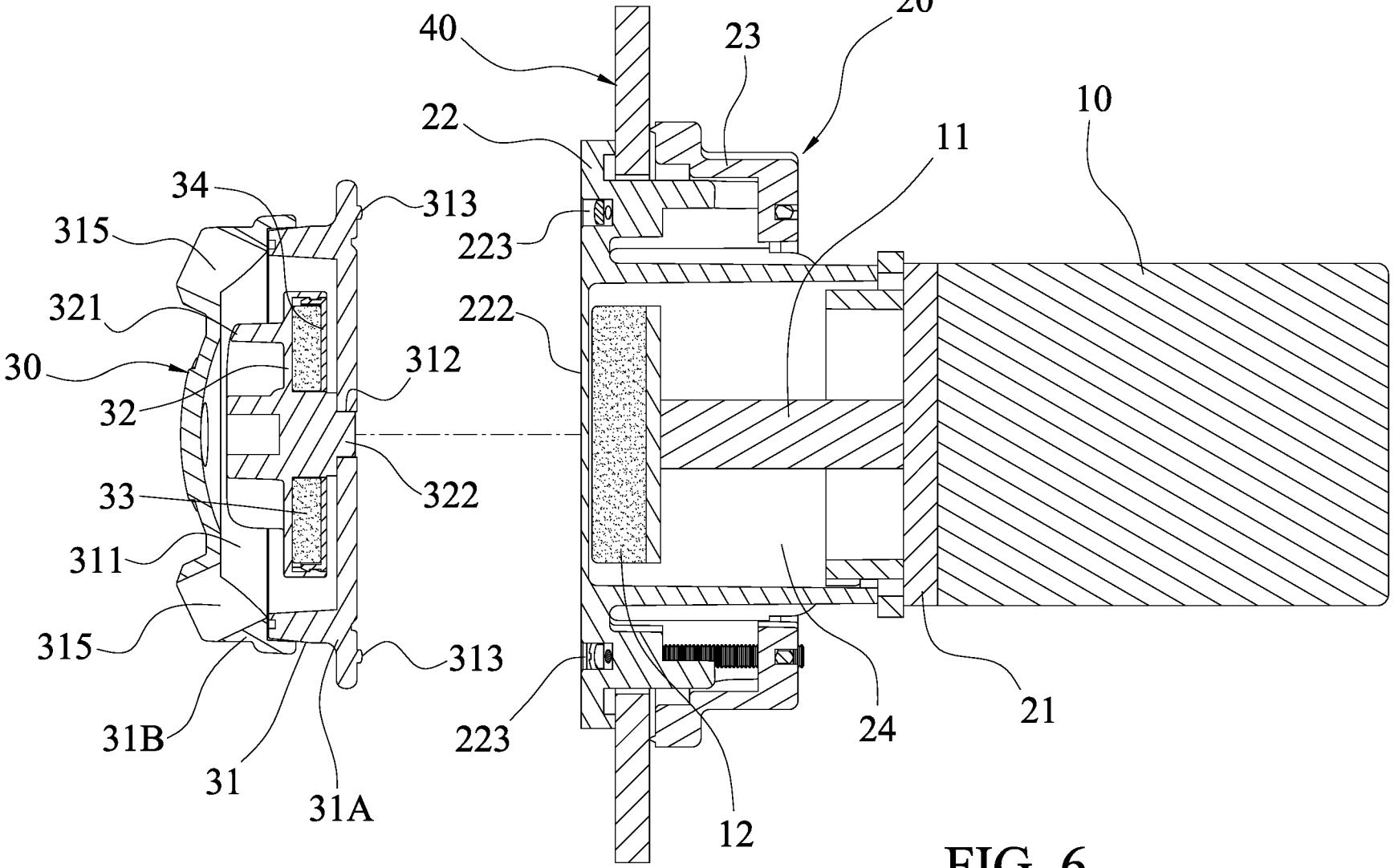
FIG. 6 is a cross sectional view showing the exploded components of the magnetic couple jet according to the first embodiment of the present invention.

The present invention will be clearer from the following description when viewed together with the accompanying drawings, which show, for purpose of illustrations only, a preferred embodiment in accordance with the present invention.

With reference to FIGS. 1-6, a magnetic couple jet for hydrotherapy spa equipment according to a first embodiment of the present invention includes a motor 10, a fixer 20, and a water jet assembly 30.

The motor 10 includes a rotary shaft 11 and a magnet disc set 12 connected on the rotary shaft 11.

The fixer 20 includes a first positioning holder 21, a second positioning holder 22, and a fixing ring 23. The first positioning holder 21 is locked on the motor 10, and the first positioning holder 21 has a first connection portion 211, the second positioning holder 22 has a second connection portion 221 connected with the first connection portion 211 of the first positioning holder 21, a coupling face 222 formed on an end of the second positioning holder 22 away from the first positioning holder 21, and at least one first affix portion 223 arranged on the coupling face 222. An accommodation chamber 24 is defined between the second positioning holder 22 and the first positioning holder 21 so as to accommodate the rotary shaft 11 and the magnet disc set 12 of the motor 10, and the magnet disc set 12 is proximate to the coupling face 222. The fixing ring 23 is locked with the second positioning holder 22 by ways of a forcing ring 231 and is clamped on a peripheral wall 40 of the hydrotherapy spa equipment.

The water jet assembly 30 includes a covering member 31, an impeller 32, a magnet 33, and a lid 34, wherein the covering member 31 has a holding seat 31A, a cap 31B connected with the holding seat 31A, a receiving room 311 formed in the covering member 31 (i.e., the holding seat 31A and the cap 31B). The holding seat 31A has an orifice 312 formed on a center of one surface thereof facing the cap 31B, and at least one second affix portion 313 arranged on the one surface of the holding seat 31A away from the cap 31B and corresponding to the at least one first affix portion 223 of the fixer 20. In this embodiment, the at least one first affix portion 223 is a notch, and the at least one second affix portion 313 is a protrusion corresponding to the notch. The cap 31B has at least one inlet 314 and at least one outlet 315 communicating with the receiving room 311. In this embodiment, the cap 31B has two inlets 314 defined on a center thereof and has two opposite outlets 315 arranged adjacent to a peripheral side of the cap 31B. The impeller 32 is housed in the receiving room 311, and the impeller 32 has multiple fans 321 radially arranged on one surface thereof facing the cap 31B, a column 322 integrally formed on a center of the other surface of the impeller 32 and rotatably connected in the orifice 312 of the holding seat 31A so that the impeller 32 is driven by an external force to rotate. The impeller 32 further has a housing groove 323 formed on the other surface thereof opposite to the holding seat 31A and accommodating the magnet 33. The lid 34 contacts with the one surface of the impeller 32 facing the holding seat 31A so as to limit the magnet 33 in the housing groove 323. When the magnet 33 magnetically attracts with the magnet disc set 12 of the motor 10 to produce magnetic field and the at least one second affix portion 313 of the holding seat 31A connects with the at least one first affix portion 223 of the fixer 20, the water jet assembly 30 magnetically attracts with the coupling face 222 of the fixer 20, the magnet disc set 12 of the rotary shaft 11 of the motor 10 actuates the magnet 33 and the impeller 32 to revolve via the magnetic field, and the water jet assembly 30 is detachable from the coupling face 222 of the fixer 20 based on using requirements.

In use, the fixing ring 23 of the fixer 20 is locked with the second positioning holder 22 by ways of the forcing ring 231 and is clamped on the peripheral wall 40 of hydrotherapy spa equipment. The water jet assembly 30 is fixed on the coupling face 222 of the fixer 20, and the magnet disc set 12 of the rotary shaft 11 of the motor 10 actuates the magnet 33 and the impeller 32 to revolve, wherein the impeller 32 draws and actuates water to flow into the receiving room 311 of the covering member 31 from the at least one inlet 314 of the cap 31B, and the water is drawn by the impeller 32 to spray out of the water jet assembly 30 from the receiving room 311 of the covering member 31 via the at least one outlet 315.

Figure 7:
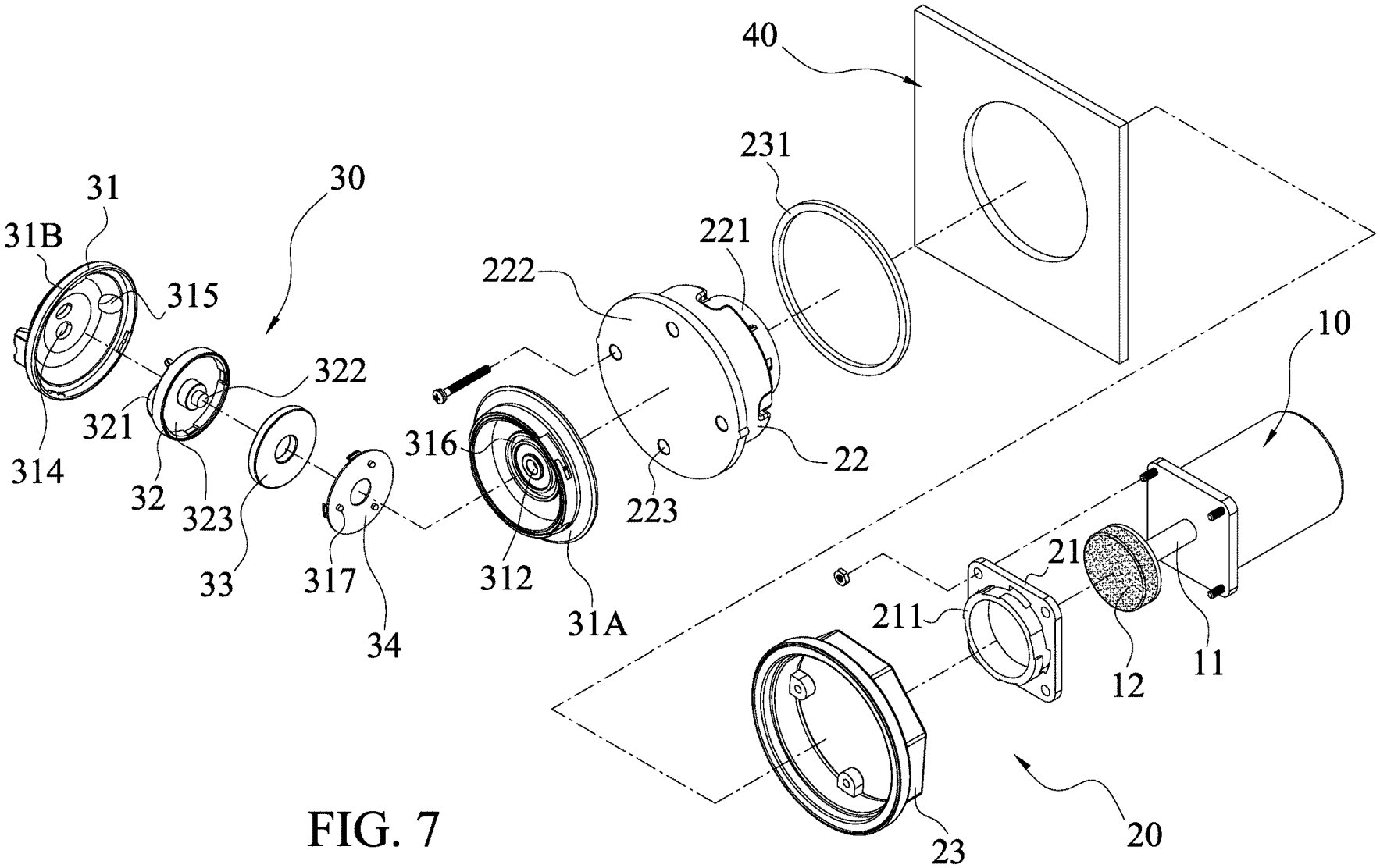
FIG. 7 is a perspective view showing the exploded components of a magnetic couple jet for hydrotherapy spa equipment according to a second embodiment of the present invention.
Figure 8:
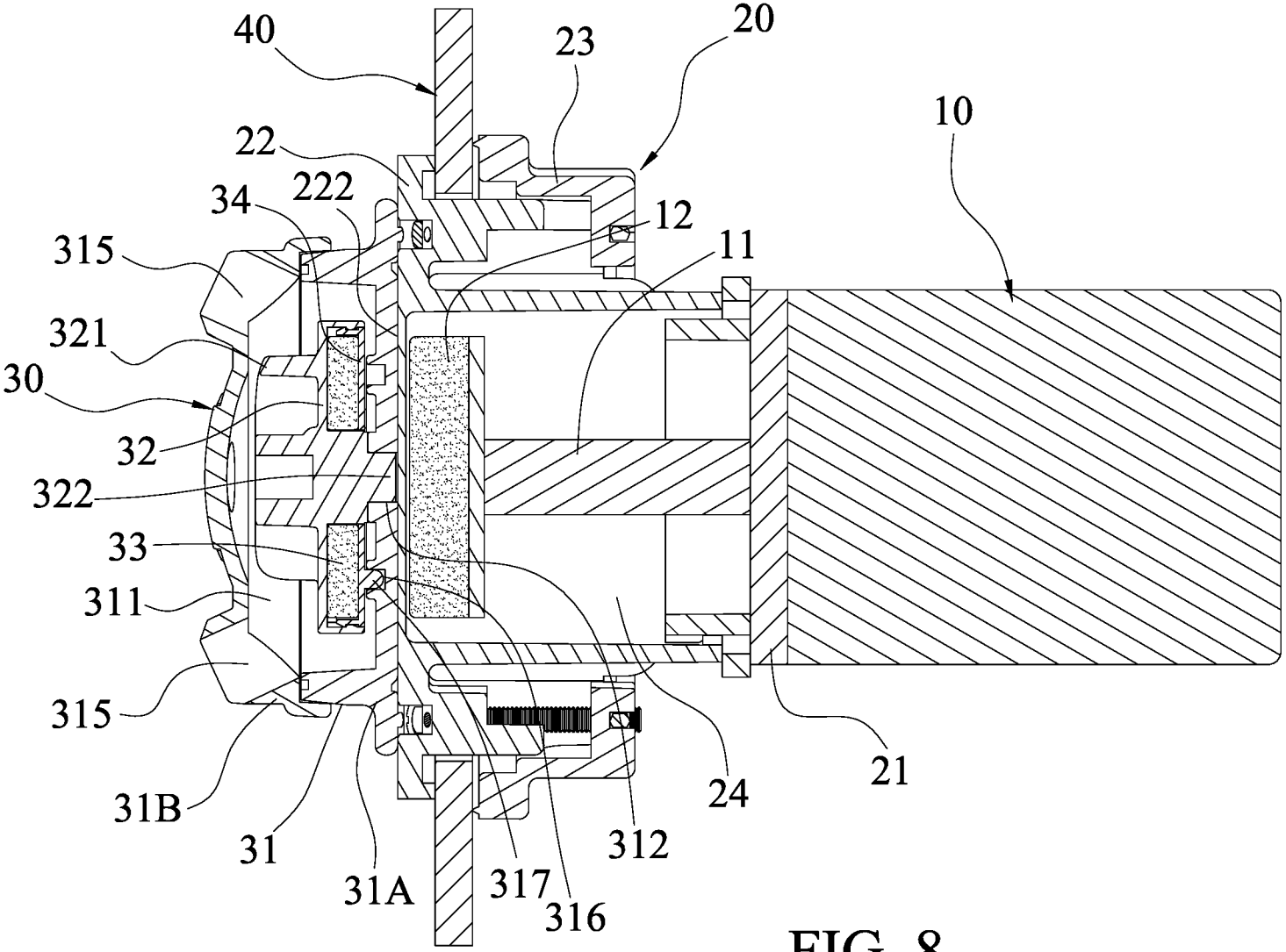
FIG. 8 is a cross sectional view showing the assembly of the magnetic couple jet according to the second embodiment of the present invention.

Referring to FIGS. 7 and 8, a difference of a magnetic couple jet of a second embodiment from that of the first embodiment includes an annular trough 316 formed on the one surface of the holding seat 31A facing the cap 31B outside the orifice 312 of the cap 31B, and multiple slidable projections 317 arranged on a surface of the lid 34 facing the holding seat 31A. In this embodiment, three slidable projections 317 are arranged on the surface of the lid 34 facing the holding seat 31A and are retained in the annular trough 316, wherein when the impeller 32 rotates, the three slidable projections 317 are driven by the impeller 32 to slide in the annular trough 315 so that the impeller 32 rotates stably.

Thereby, the magnetic couple jet of the present invention has advantages as follows:

the impeller 32 has the column 322 extending on a center of a surface thereof facing the holding seat 31A, the holding seat 31A has the orifice 312 defined on a center of a surface thereof facing the cap 31B, and the column 322 is inserted into and rotatably connected with the orifice 312 of the holding seat 31A, so that the water jet assembly 30 is simplified, machined easily, and its fabrication cost and failure rate are reduced, thus enhancing market competitiveness.

While various embodiments in accordance with the present invention have been shown and described, it is clear to those skilled in the art that further embodiments may be made without departing from the scope of the present invention.

What is claimed is:

1. A magnetic couple jet for hydrotherapy spa equipment comprising:

a motor including a rotary shaft and a magnet disc set connected on the rotary shaft;

a fixer including a first positioning holder and a second positioning holder, the first positioning holder being locked on the motor, and the second positioning holder being connected with the first positioning holder, wherein the second positioning holder has a coupling face formed on an end of the second positioning holder away from the first positioning holder, at least one first affix portion is arranged on the coupling face, and an accommodation chamber is defined between the second positioning holder and the first positioning holder so as to accommodate the rotary shaft and the magnet disc set of the motor;

a water jet assembly including a covering member, an impeller, and a magnet, wherein the covering member has a holding seat, a cap connected with the holding seat, and a receiving room formed in the holding seat and the cap, the holding seat has an orifice formed on one surface thereof facing the cap, at least one second affix portion being back to the holding seat corresponding to the at least one first affix portion of the fixer, at least one inlet, and at least one outlet communicating with the receiving room, the holding seat has at least one inlet and at least one outlet communicating with the receiving room;

wherein the impeller is housed in the receiving room, and the impeller has multiple fans radially arranged on one surface thereof facing the cap, a column formed on a center of the other surface of the impeller and rotatably connected in the orifice of the cap so that the impeller is driven by an external force to rotate, and a housing groove formed on the other surface thereof opposite to the cap and accommodating the magnet; when the magnet magnetically attracts with the magnet disc set of the motor to produce magnetic field and the at least one second affix portion of the cap connects with the at least one first affix portion of the fixer, the water let assembly magnetically attracts with the coupling face of the fixer, the magnet disc set of the rotary shaft of the motor actuates the magnet and the impeller to revolve via the magnetic field, wherein the fixer further includes a fixing ring locked with the second positioning holder by ways of a forcing ring.

2. The magnetic couple jet as claimed in claim 1, wherein the at least one first affix portion is a notch, and the at least one second affix portion is a protrusion corresponding to the notch.

3. The magnetic couple jet as claimed in claim 1, wherein the first positioning holder has a first connection portion, the second positioning holder has a second connection portion connected with the first connection portion of the first positioning holder.

4. The magnetic couple jet as claimed in claim 1, wherein the magnet disc set is proximate to the coupling face.

5. A magnetic couple jet for hydrotherapy spa equipment comprising:

a motor including a rotary shaft and a magnet disc set connected on the rotary shaft;

a fixer including a first positioning holder and a second positioning holder, the first positioning holder being locked on the motor, and the second positioning holder being connected with the first positioning holder, wherein the second positioning holder has a coupling face formed on an end of the second positioning holder away from the first positioning holder, at least one first affix portion is arranged on the coupling face, and an accommodation chamber is defined between the second positioning holder and the first positioning holder so as to accommodate the rotary shaft and the magnet disc set of the motor;

a water let assembly including a covering member, an impeller, and a magnet, wherein the covering member has a holding seat, a cap connected with the holding seat, and a receiving room formed in the holding seat and the cap, the holding seat has an orifice formed on one surface thereof facing the cap, at least one second affix portion being back to the holding seat corresponding to the at least one first affix portion of the fixer, at least one inlet, and at least one outlet communicating with the receiving room, the holding seat has at least one inlet and at least one outlet communicating with the receiving room;

wherein the impeller is housed in the receiving room, and the impeller has multiple fans radially arranged on one surface thereof facing the cap, a column formed on a center of the other surface of the impeller and rotatably connected in the orifice of the cap so that the impeller is driven by an external force to rotate, and a housing groove formed on the other surface thereof opposite to the cap and accommodating the magnet; when the magnet magnetically attracts with the magnet disc set of the motor to produce magnetic field and the at least one second affix portion of the cap connects with the at least one first affix portion of the fixer, the water jet assembly magnetically attracts with the coupling face of the fixer, the magnet disc set of the rotary shaft of the motor actuates the magnet and the impeller to revolve via the magnetic field, wherein the water jet assembly includes a lid contacting with the one surface of the impeller facing the cap so as to limit the magnet in the housing groove.

6. A magnetic couple jet for hydrotherapy sea equipment comprising:

a motor including a rotary shaft and a magnet disc set connected on the rotary shaft;

a fixer including a first positioning holder and a second positioning holder, the first positioning holder being locked on the motor, and the second positioning holder being connected with the first positioning holder, wherein the second positioning holder has a coupling face formed on an end of the second positioning holder away from the first positioning holder, at least one first affix portion is arranged on the coupling face, and an accommodation chamber is defined between the second positioning holder and the first positioning holder so as to accommodate the rotary shaft and the magnet disc set of the motor;

a water let assembly including a covering member, an impeller, and a magnet, wherein the covering member has a holding seat, a cap connected with the holding seat, and a receiving room formed in the holding seat and the cap, the holding seat has an orifice formed on one surface thereof facing the cap, at least one second affix portion being back to the holding seat corresponding to the at least one first affix portion of the fixer, at least one inlet, and at least one outlet communicating with the receiving room, the holding seat has at least one inlet and at least one outlet communicating with the receiving room;

wherein the impeller is housed in the receiving room, and the impeller has multiple fans radially arranged on one surface thereof facing the cap, a column formed on a center of the other surface of the impeller and rotatably connected in the orifice of the cap so that the impeller is driven by an external force to rotate, and a housing groove formed on the other surface thereof opposite to the cap and accommodating the magnet; when the magnet magnetically attracts with the magnet disc set of the motor to produce magnetic field and the at least one second affix portion of the cap connects with the at least one first affix portion of the fixer, the water jet assembly magnetically attracts with the coupling face of the fixer, the magnet disc set of the rotary shaft of the motor actuates the magnet and the impeller to revolve via the magnetic field, wherein the holding seat has an annular trough formed on the one surface thereof facing the cap outside the orifice of the cap, and multiple slidable projections arranged on a surface of the lid facing the holding seat, wherein the multiple slidable projections are retained in the annular trough, and when the impeller rotates, the multiple slidable projections are driven by the impeller to slide in the annular trough.

* * * * *